US010526779B2

(12) United States Patent
Knudson

(10) Patent No.: US 10,526,779 B2
(45) Date of Patent: Jan. 7, 2020

(54) DOUBLE-INSULATED DOUBLE-CLAD METAL BUILDING SYSTEM

(71) Applicant: Gary A. Knudson, Oak Creek, CO (US)

(72) Inventor: Gary A. Knudson, Oak Creek, CO (US)

( * ) Notice: Subject to any disclaimer, the term of this patent is extended or adjusted under 35 U.S.C. 154(b) by 0 days.

(21) Appl. No.: 15/968,308

(22) Filed: May 1, 2018

(65) Prior Publication Data

US 2019/0338509 A1 Nov. 7, 2019

(51) Int. Cl.

| | |
|---|---|
| ***E04B 1/24*** | (2006.01) |
| ***E04C 3/08*** | (2006.01) |
| ***E04C 2/292*** | (2006.01) |
| ***E04C 2/32*** | (2006.01) |

(52) U.S. Cl.

CPC ..... *E04B 1/24* (2013.01); *E04B 1/2403* (2013.01); *E04C 2/292* (2013.01); *E04C 2/322* (2013.01); *E04C 3/08* (2013.01); *E04B 2001/249* (2013.01); *E04B 2001/2415* (2013.01); *E04B 2001/2463* (2013.01); *E04B 2001/2472* (2013.01); *E04B 2001/2481* (2013.01)

(58) Field of Classification Search

CPC . E04C 2/322; E04C 2/292; E04C 3/08; E04C 2002/345; E04C 2002/3455; E04C 2002/3461; E04C 2002/3466; E04B 1/24; E04B 1/2403; E04B 2001/2481

See application file for complete search history.

(56) References Cited

U.S. PATENT DOCUMENTS

| | | | | | |
|---|---|---|---|---|---|
| 3,064,771 | A | * | 11/1962 | Behlen | E04B 1/3205 52/245 |
| 3,439,459 | A | * | 4/1969 | Silberkuhl | E04B 1/3205 52/18 |
| 4,070,805 | A | * | 1/1978 | Kastner | E04B 1/24 472/94 |
| 4,099,359 | A | * | 7/1978 | Sivachenko | E01D 19/125 405/284 |
| 4,120,123 | A | * | 10/1978 | Knudson | E04B 1/18 52/406.2 |
| 4,186,541 | A | * | 2/1980 | Sivachenko | E01D 19/02 52/630 |
| 4,291,510 | A | * | 9/1981 | Sivachenko | E04D 3/30 52/22 |

(Continued)

FOREIGN PATENT DOCUMENTS

| | | | | |
|---|---|---|---|---|
| FR | 2132035 A1 | * | 11/1972 | E04B 7/107 |
| GB | 2044316 | * | 10/1980 | |

*Primary Examiner* — Adriana Figueroa

(74) *Attorney, Agent, or Firm* — Ancel W. Lewis, Jr.; Cochran Freund & Young LLP

(57) ABSTRACT

A metal building system has multiple spaced building sections connected by inner and outer batten panels. Each building section has two spaced frame elements connected by inner and outer skin panels. The frame elements have two walls and a roof. The batten and skin panels have a metal layer that faces away from the frame elements and an insulation layer that faces the frame elements. The skin panels are seamed to the frame element and the batten panels are seamed to the skin panels such that there is no metal to metal contact between the frame elements, the skin panels and the batten panels. Each building section can be assembled at ground level, rotated to a final upright position and anchored.

16 Claims, 5 Drawing Sheets

(56) References Cited

U.S. PATENT DOCUMENTS

| | | | | | |
|---|---|---|---|---|---|
| 4,365,453 | A * | 12/1982 | Lowe | E04B 1/08 | 52/478 |
| 4,616,453 | A | 10/1986 | Sheppard, Jr. et al. | | |
| 5,269,106 | A * | 12/1993 | Stafford | E04B 7/022 | 135/122 |
| 5,326,191 | A * | 7/1994 | Wilson | E01F 5/005 | 285/903 |
| 5,526,628 | A * | 6/1996 | Knudson | E04B 1/08 | 52/528 |
| 6,691,488 | B2 * | 2/2004 | Branson | A01K 1/00 | 119/437 |
| 6,901,708 | B1 | 6/2005 | Powers, III | | |
| 9,109,352 | B1 * | 8/2015 | Knudson | E04B 1/24 | |
| 9,273,458 | B2 * | 3/2016 | Davis | E04B 1/24 | |
| 9,869,090 | B2 * | 1/2018 | Wilson | E01F 5/005 | |
| 2001/0023561 | A1 * | 9/2001 | Henbid | E04H 15/18 | 52/222 |
| 2003/0143028 | A1 * | 7/2003 | Wilson | E01F 5/005 | 405/124 |

* cited by examiner

DOUBLE-INSULATED DOUBLE-CLAD METAL BUILDING SYSTEM

TECHNICAL FIELD

The present invention relates to buildings, and more particularly to a building system with frame elements, and inner and outer insulated cladding panels of roll formed light gauge metal.

BACKGROUND ART

Many prior known metal buildings systems lack innovative and efficient means for insulation against heat transfer, or efficient means for applying or assembling the insulation. The two main categories of metal buildings are frameless, and frame and cladding. Frameless buildings are made from arch shaped panels that can be roll formed at the assembly site and seamed together. U.S. Pat. No. 3,967,430 to the present applicant, and the related patents, disclose an example of a building system of roll formed, arch shaped panels.

Frameless buildings are usually insulated with spray-on insulation material such as urethane foam or cellulose applied to the inside surface of the finished building. A sealer or flame resistant coating is usually required over the insulation. Only moderate R-values and poor surface finishes are achieved with these spray-on insulations. Also, frameless building systems are not as suitable for traditional building shapes that have vertical walls and a flat or pitched roof Known frame and cladding metal buildings are generally designed and fabricated in-plant as kits for complete buildings of a specified dimension, then packaged and shipped to the distributor and ultimately the end user where the parts are finally assembled at the job site. This assembly process requires heavy cranes to erect relatively heavy steel frames and hundreds of hours to screw fasten the metal outer cladding sheets onto the purlin structures of these frames. Some of the disadvantages of these prior building practices are that the ultimate user must often order the building well in advance of installation, must absorb high costs in packaging, shipping, and insurance as well as final assembly. Nor do these prior practices provide any opportunity for changes in the final dimension or size in the building. Once ordered, the user cannot readily change an original choice.

U.S. Pat. No. 5,651,230 to the present applicant discloses an example of a metal building system with vertical walls and a pitched roof having a relatively simple frame and cladding panels. The components can be formed on site and the framing jig disclosed is adjustable in size and shape to form buildings of different heights and widths. The framing jig rotates to erect building sections, so that a heavy crane is not required to erect the frame. A building system with fewer frame parts in each frame element will reduce fabrication and assembly costs. Greater cross-section strength in the cladding panels will reduce the number of sections and frame elements required for a building of a given size, and thereby reduce material, fabrication and assembly costs.

Frame and cladding metal buildings are usually insulated with cumbersome roll-batten insulation applied across the purlins that connect the frame elements. The insulation is covered by light-gauge inner cladding secured by screws that extend through the cladding and insulation, and into the purlins. The screws allow heat transfer between the inner cladding, the frame elements and the outer cladding.

DISCLOSURE OF THE INVENTION

A metal building system includes a foundation, a plurality of longitudinally spaced building sections, and inner and outer batten panels. The foundation has a substantially flat floor and two laterally spaced, longitudinally extending sets of spaced base rails that project upwardly relative to the floor. The building sections each have two longitudinally spaced frame elements, inner skin panels and outer skin panels. The frame elements each include two laterally spaced wall portions each having a lower end and an upper end, and two roof portions that each connect to the upper end of one of the wall portions and extend upwardly and inwardly to connect together at a roof peak. The wall and roof portions have an inner frame chord with an inner edge having a shaped inner flange, a spaced outer frame chord with an outer edge having a shaped outer flange and a plurality of struts connecting the inner and outer chords. The inner and outer chords are spaced to receive and connect to the base rails at the lower end. The inner and outer skin panels extend between the wall and roof portions of the frame elements, and have spaced side edges with seams that connect to the inner and outer chords. The inner and outer batten panels extend between and connect consecutive building sections. The inner and outer skin panels, and the inner and outer batten panels have a metal layer and an insulation layer attached to and substantially coextensive with the metal layer, with the insulation layer facing towards the wall and roof portions, so that the insulation layer spaces the metal layer from the wall and roof portions and thermally isolates the inner and outer skin panels, and the inner and outer batten panels from the frame elements.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
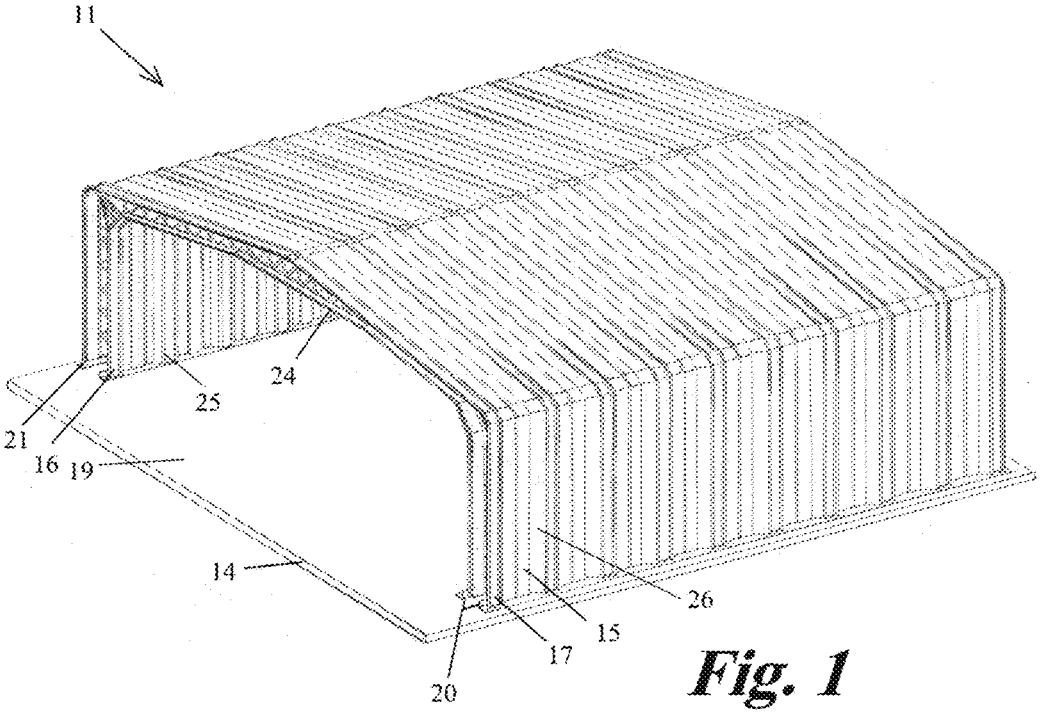
FIG. 1 is a perspective view of a building system embodying features of the present invention.

Referring to FIGS. 1 to 11, a metal building system 11, embodying features of the present invention, includes a foundation 14, a plurality of longitudinally spaced building sections 15, and inner and outer batten panels 16 and 17. The foundation 14 has a substantially flat floor 19 and two laterally spaced sets 20 of base rails 21. Each set 20 includes two longitudinally extending, laterally spaced, upwardly projecting base rails 21 mounted to the floor 19. The base rails 21 shown are angle irons having one portion mounted to the floor 19 and the other portion projecting upwardly. A plurality of longitudinally spaced, hollow anchor apertures 22 extend laterally through each base rail 21. A layer of insulation 23 extends along the floor 19 from one base rail 21 to the other base rail 21 of a set 20.

Figure 2:
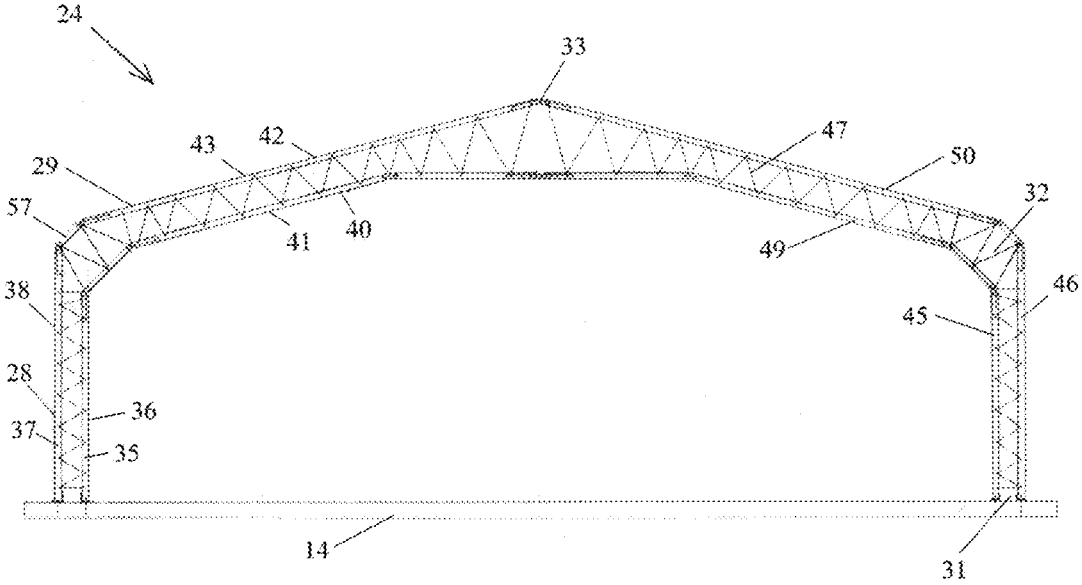
FIG. 2 is a front elevation view of a frame element and the foundation of the building system of FIG. 1.

Each building section 15 includes two longitudinally spaced frame elements 24, inner skin panels 25 and outer skin panels 26. As shown in FIG. 2, each frame element has two laterally spaced wall portions 28 and two roof portions 29. Each wall portion 28 has a lower end 31 and a spaced upper end 32. The roof portions 29 connect to the upper ends 32 of the wall portions 28, and extend upwardly and inwardly to meet and connect together at a roof peak 33.

The wall portions 28 have an inner edge 35 with a shaped inner flange 36 and a spaced outer edge 37 with a shaped outer flange 38. The roof portions 29 have an inner edge 40 with a shaped inner flange 41 and a spaced outer edge 42 with a shaped outer flange 43. The wall portions 28 include an L-shaped inner frame chord 45 along the inner edge 35, a spaced, L-shaped outer frame chord 46 along the outer edge 37 and a plurality of struts 47 connecting the inner and outer chords 45 and 46. The roof portions 29 include an L-shaped inner frame chord 49 along the inner edge 40, a spaced, L-shaped outer frame chord 50 along the outer edge 42 and a plurality of struts 47 connecting the inner and outer chords 49 and 50. The struts 47 generally extend diagonally between the inner frame chords 45 and 49 and the outer frame chords 46 and 50 of the wall and roof portions 28 and 29, in a zigzag arrangement.

Figure 3:
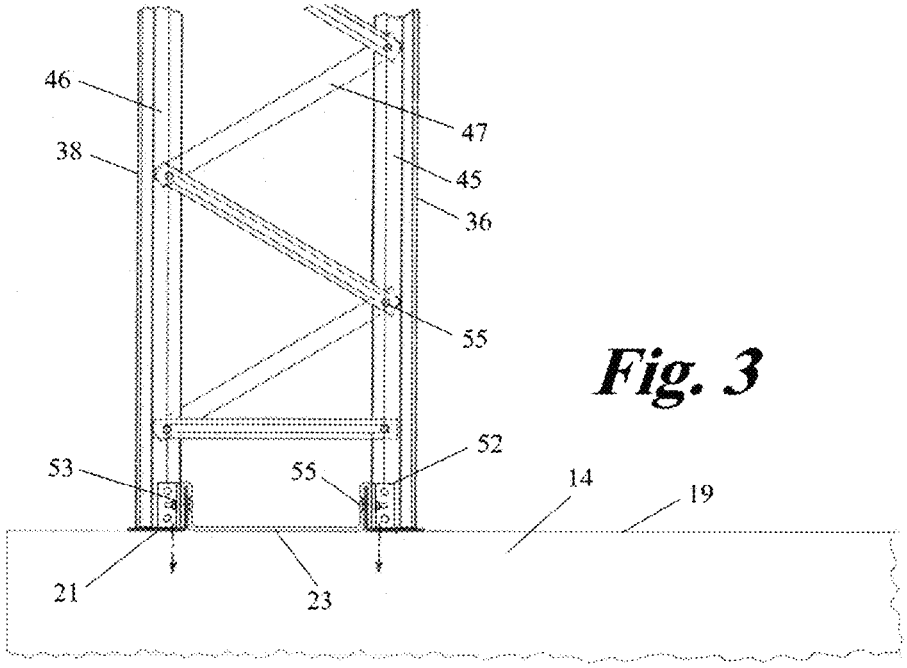
FIG. 3 is an enlarged front elevation view of the lower end of a wall portion of the frame element of FIG. 2.

The inner and outer frame chords 45 and 46 shown of the wall portions 28 diverge slightly upwardly. The base rails 21 are spaced to fit between the inner and outer frame chords 45 and 46 at the lower end 31 of each wall portion 28. Referring to FIG. 3, the inner and outer frame chords 45 and 46 of the wall portions 28 each include an attachment angle 52, at the lower end 31 of the wall portion 28, with an attachment aperture 53 that extends laterally through the attachment angle 52. The anchor apertures 22 in the base rails 21 are positioned to align with the attachment apertures 53. Bolts 55 extend through the attachment apertures 53 and the anchor apertures 22 to anchor the frame element 24 to the foundation 14.

Figure 4:
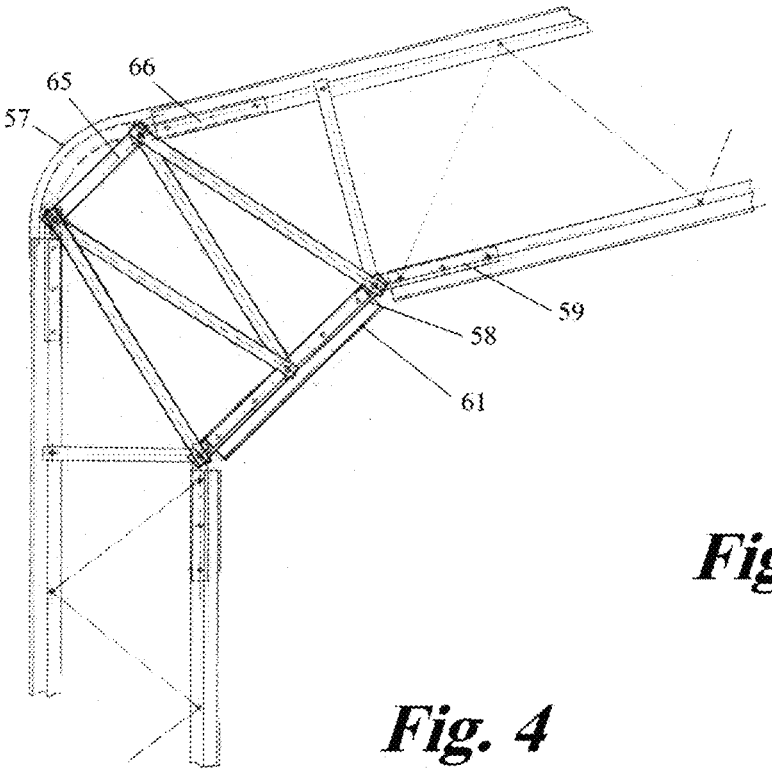
FIG. 4 is an enlarged front elevation view of the hip area of the frame element of FIG. 2.
Figure 5:
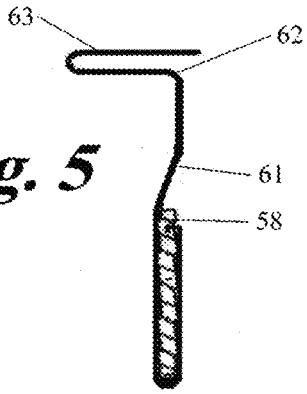
FIG. 5 is an enlarged end view of the inner hip chord of FIG. 4.

The inner frame chords 45 and 49 and the outer frame chords 46 and 50 of the wall and roof portions 28 and 29, and generally the struts 47 are roll formed from light gauge metal. The wall and roof portions 28 and 29 connect at a hip 57. As shown in FIG. 4, the inner frame chords 45 and 49 of the wall and roof portions 28 and 29 are connected at the hip 57 by an inner hip bar 58 that angles between the substantially vertical inner frame chord 45 of the wall portion 28 and the sloped inner frame chord 49 of the roof portion 29. Inner hip bolster bars 59 are connected with bolts 55 to the inner frame chords 45 and 49 from the inner hip bar 58 along a portion of the inner frame chord 45 and from the inner hip bar 58 along a portion of the inner frame chord 49 to reinforce the hip 57. An inner hip chord 61, shown in FIGS. 4 and 5, attaches to and extends along the inner hip bar 58. The inner hip chord 61 has an inner edge 62 with a shaped inner flange 63.

The outer frame chords 46 and 50 of the wall and roof portions 28 and 29 are connected at the hip 57 by an outer hip bar 65 that angles between the substantially vertical outer frame chord 46 of the wall portion 28 and the sloped outer frame chord 50 of the roof portion 29. Outer hip bolster bars 66 are connected with bolts 55 to the outer frame chords 46 and 50 from the outer hip bar 65 along a portion of the outer frame chord 46 and from the outer hip bar 65 along a portion of the outer frame chord 50 to reinforce the hip 57.

Figure 6:
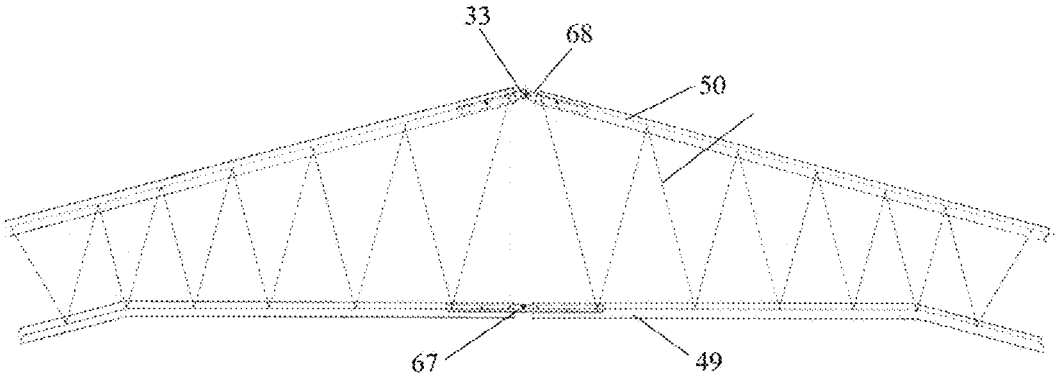
FIG. 6 is an enlarged front elevation view of the roof peak of the frame element of FIG. 2.

Referring to FIG. 6, inner roof peak bars 67 are bolted with bolts 55 to the inner frame chords 49 of the roof portions 29 to connect the inner frame chords 49 at the roof peak 33. Outer roof peak bars 68 are bolted with bolts 55 to the outer frame chords 50 of the roof portions 29 to connect the outer frame chords 50 at the roof peak 33.

Figure 7:
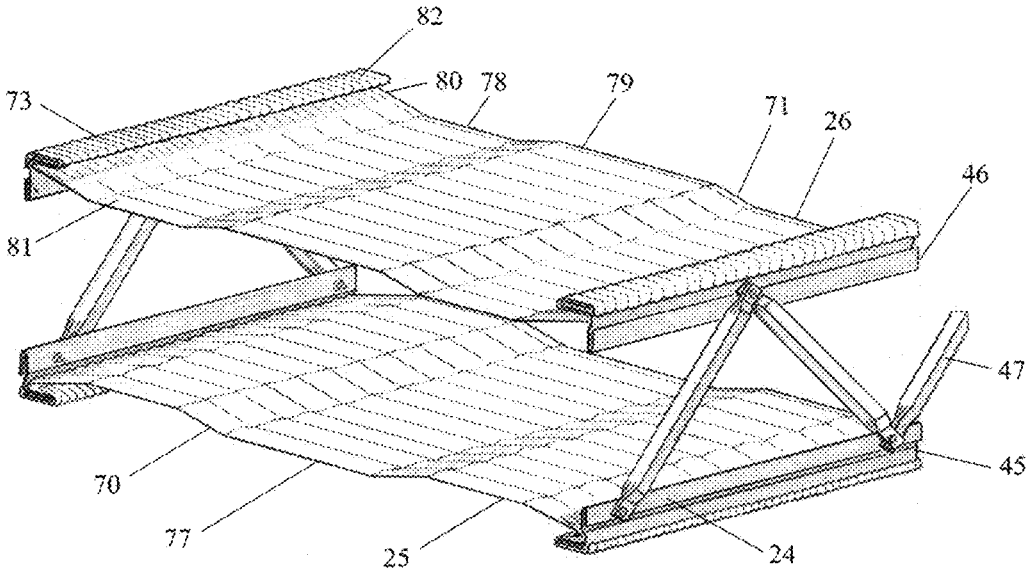
FIG. 7 is a partial perspective view of a building section of the building system of FIG. 1.
Figure 8:
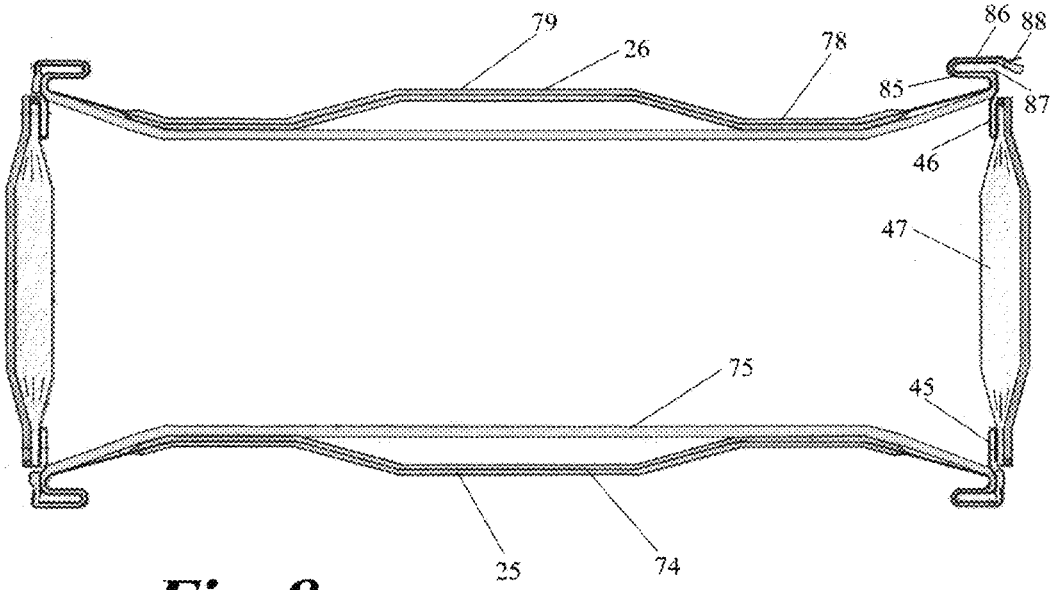
FIG. 8 is a top plan view of the building section of FIG. 7.

FIGS. 7 and 8 shows the inner skin panels 25 and outer skin panels 26 on the frame elements 24. Inner cladding panels 70 include the inner batten panels 16 and the inner skin panels 25. Outer cladding panels 71 include the outer batten panels 17 and the outer skin panels 26. The inner and outer cladding panels 70 and 71 each have two spaced side edges 73 with a metal layer 74 that extends between the side edges 73 and an insulation layer 75 that is attached to and substantially coextensive with the metal layer 74. Preferably the metal layer 74 is roll formed, light gauge metal and the insulation layer 75 is aluminized foil-bubble insulation. Each inner or outer cladding panel 70 or 71 can extend from the roof peak 33 to the lower end 31 of the wall portion 28.

The inner and outer skin panels 25 and 26 are generally the same shape. The inner skin panels 25 are assembled to be concave inwardly with the insulation layer 75 facing outwardly. The outer skin panels 26 are assembled to be concave outwardly with the insulation layer 75 facing inwardly. The inner and outer skin panels 25 and 26 have a center section 77 with two wide, shallow, spaced, longitudinal channels 78 connected by a flat ridge 79, and edge portions 80 along the side edges 73. Large corrugations 81 extend across the center section 77 to provide rigidity between the side edges 73 of the inner and outer skin panels 25 and 26. Small corrugations 82 extend from the large corrugations 81 across the edge portions 80.

The building section 15 is assembled with the inner flanges 36 and 41 of wall and roof portions 28 and 29 of the two frame elements 24 projecting towards each other and the outer flanges 38 and 43 of wall and roof portions 28 and 29 of the two frame elements 24 projecting towards each other. The side edges 73 of the inner skin panels 25 each include a seam 84 the connects the inner skin panels 25 to the inner flanges 41 of the two frame elements 24. The side edges 73 of the outer skin panels 26 each include a seam 84 the connects the outer skin panels 26 to the outer flanges 43 of the two frame elements 24.

Figure 9:
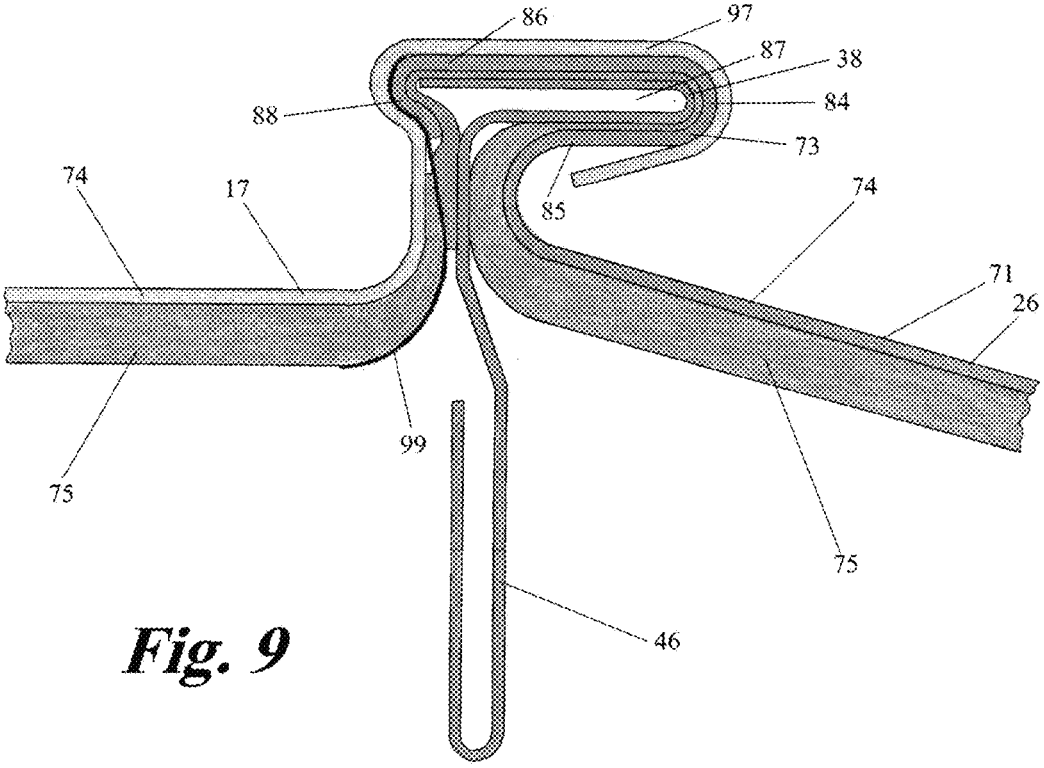
FIG. 9 is a enlarged top view of the seams of a batten panel and a skin panel on a chord of the building system of FIG. 1.

Referring to FIGS. 8 and 9, the seams 84 include first portions 85 that project towards each other from opposite side edges 73, second portions 86 that are folded away from the center section 77 and then back to project in the opposite direction as the first portions 85 to form narrow slots 87, and third portions 88 connected to the second portions 86. The slot 87 is sized to receive an inner or outer flange 36, 41, 38 or 43. The third portion 88 projects in the same direction as the second portion 86 prior to final forming of the seam 84. After the inner or outer flange 36, 41, 38 or 43 is assembled into the slot 87, the third portion 88 is folded transverse to the second portion 86 to capture the inner or outer flange 36, 41, 38 or 43.

The small corrugations 82 facilitate forming the seam 84 while balancing stress and shrinkage from the forming of the large corrugations 81. The insulation layer 75 is on the inside of the slots 87, mechanically attaching the insulation layer 75 to the metal layer 74. The insulation layer 75 is on the inside of the slots 87 so that the metal layer 74 does not contact the frame elements 24, thermally isolating the inner and outer skin panels 25 and 26 from the frame elements 24.

The inner chords 45 and 49 of the wall and roof portions 28 and 29 can be assembled and seamed to an inner skin panel 25 at a factory, without the inner hip bar 58 or a bend at the hip 57, to provide a substantially flat, stackable unit for shipping. The outer chords 46 and 50 of the wall and roof portions 28 and 29 can be assembled and seamed to an outer skin panel 26 at a factory, without the outer hip bar 65 or a bend at the hip 57, to provide a substantially flat, stackable unit for shipping. After arrival at the job site, the inner skin panel 25 can be bent at the hip 57, and the inner hip bar 58, bolster bars 59 and inner hip chord 51 can be assembled. After arrival at the job site, the outer skin panel 25 can be bent at the hip 57, and the outer hip bar 65 and bolster bars 66 can be assembled.

Figure 10:
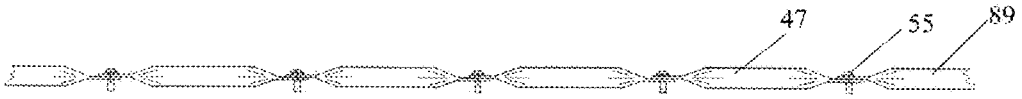
FIG. 10 is a top plan view of a chain of struts for the frame element of FIG. 2.
Figure 11:
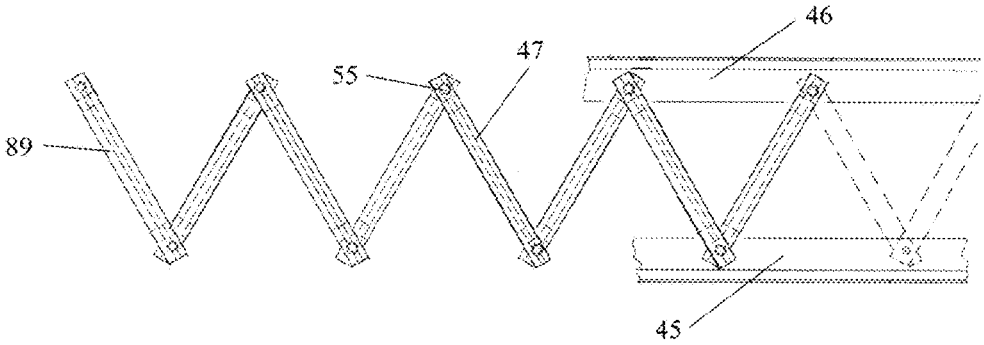
FIG. 11 is a partial side elevation view of the chain of struts of FIG. 10 assembled to a frame element.

As shown in FIGS. 10 and 11, the struts 47 can be preassembled into a chain 89 connected with bolts 55 for faster assembly at the job site. The struts 47 shown have a rectangular cross section with longitudinal corrugations along the short sides and flattened ends. The corrugations allow the ends to be flattened without the ends flaring or widening. The struts can also be round, square, channel shaped or hat shaped roll-formed sections.

The frame elements 24, and inner and outer skin panels 25 and 26 of the building section 15 can be assembled in a substantially horizontal position on the foundation 14 with the bolts 55 through the anchor apertures 22 and the attachment apertures 53 of one of the frame elements 24. After assembly of the building section 15, the building section 15 can be rotated to the final, vertical position and the bolts 55 can be assembled through the anchor apertures 22 and the attachment apertures 53 of the other frame element 24. As each consecutive building section 15 is assembled, inner and outer batten panels 16 and 17 are applied to connect adjacent building sections 15.

Figure 12:
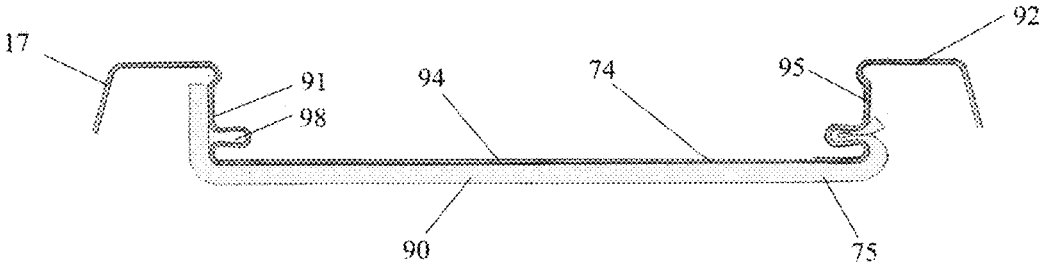
FIG. 12 is a top plan view of a batten panel of the building system of FIG. 1.

Referring to FIG. 12, the inner and outer batten panels 16 and 17 have a channel shape with a center portion 90, two spaced side portions 91 that extend transversely from the center portion 90 and two edge portions 92 along the side edges 73. The inner batten panels 16 are assembled to be concave inwardly with the insulation layer 75 facing outwardly. The outer batten panels 17 are assembled to be concave outwardly with the insulation layer 75 facing inwardly.

The inner and outer batten panels 16 and 17 can include large corrugations 94 across the center portion 90 to provide rigidity between the side edges 73, and small corrugations 95 extending from the large corrugations 94 to the side edges 73. Alternatively, the inner and outer batten panels 16 and 17 can include small corrugations 95 across the center portion 90 and the side edges 73. As shown in FIG. 9, the side edges 73 of the inner and outer batten panels 16 and 17 each have a seam 97 that wraps around the seam 84 of the respective inner or outer skin panel 25 or 26. The insulation layer 75 of the inner and outer batten panels 16 and 17 spaces the metal layer 74 of the inner and outer batten panels 16 and 17 from the metal layer 74 of the inner and outer skin panels 25 and 26 to thermally isolate the inner and outer batten panels 16 and 17 from the inner and outer skin panels 25 and 26, and the frame elements 24.

The side portions 91 shown in FIG. 12 each include an inwardly projecting, outwardly concave pocket 98. The pockets are sized to receive the insulation layer 75 to mechanically attach the insulation layer 75 to the metal layer 74. Alternatively, the insulation layer 75 can be attached to the metal layer 74 with adhesive or double side tape, as shown in FIG. 9. A layer of duct tape 99 separates the insulation layer 75 of the inner and outer batten panels 16 and 17 from the insulation layer 75 of the inner or outer skin panel 25 or 26.

Although the present invention has been described with a certain degree of particularity, it is understood that the present disclosure has been made by way of example and that changes in details of structure may be made without departing from the spirit thereof.

What is claimed is:

1. A metal building system comprising:

a plurality of longitudinally spaced frame elements each including two laterally spaced wall portions each having an upper end and two roof portions that each connect to said upper end of one of said wall portions and extend upwardly and inwardly, said roof portions connecting to each other at a roof peak opposite said wall portions, each of said wall and roof portions having an inner edge with a shaped inner flange and a spaced outer edge with a shaped outer flange, said wall and roof portions include an inner frame chord along said inner edge, a spaced outer frame chord along said outer edge and a plurality of struts connecting said inner and outer chords, inner cladding panels extending between said wall portions and between said roof portions of consecutive said frame elements, said inner cladding panels having two spaced side edges, said inner cladding panels including a metal layer and an insulation layer attached to and coextensive with said metal layer, said insulation layer facing towards said wall and roof portions, said side edges each having a seam that connects said inner cladding panel to said inner flanges of said wall and roof portions of said frame elements with said insulation layer separating and spacing said metal layer from said inner flanges, and outer cladding panels extending between said portions and between said roof portions of consecutive said frame elements, said outer cladding panels having two spaced side edges, said outer cladding panels including a metal layer and an insulation layer attached to and coextensive with said metal layer, said insulation layer facing towards said wall and roof portions, said side edges each having a seam that connects said outer cladding panel to said outer flanges of said wall and roof portions of said frame elements with said insulation layer separating and spacing said metal layer from, said outer flanges, whereby said insulation layers on said inner and outer cladding panels thermally isolate said inner and outer cladding panels from said frame elements, and said inner and outer cladding panels create dead-air space for improved resistance to heat transfer.

2. The system as set forth in claim 1:

wherein said inner cladding panels include inner skin panels and inner batten panels, and said outer cladding panels include outer skin panels and outer batten panels, and including a plurality of spaced building sections each having two of said frame elements connected by said inner and outer skin panels, with said inner and outer batten panels connecting adjacent said building sections.

3. The system as set forth in claim 1:

wherein said wall portions each have a lower end, and including a foundation having a substantially flat floor and two laterally spaced, longitudinally extending sets of spaced base rails that project upwardly relative to said floor, said base rails being sized and positioned to fit between said inner and outer chords of said wall portions at said lower end.

4. The system as set forth in claim 3:

wherein said inner and outer chords each include an attachment angle at said lower end of said wall portions with said attachment angles each having an attachment aperture that extends laterally through said attachment angle, wherein said base rails include an anchor aperture for each wall portion, said anchor apertures being positioned to align with said attachment apertures in said attachment angles, and including four bolts for each frame element that extends through said anchor apertures and said attachment angles to anchor said frame elements, whereby said building sections can be assembled in a horizontal position with said bolts in said anchor apertures and said attachment apertures in said attachment angles of one of said frame elements, said building section can then be pivoted into an upright position, and said bolts can be installed in said anchor apertures and said attachment apertures in said attachment angles of the other said frame element of said building section.

5. The system as set forth in claim 2 wherein said inner skin panels and said inner batten panels are concave inwardly, and said outer skin panels and said outer batten panels are concave outwardly.

6. The system as set forth in claim 5 wherein said inner skin panels have a center section with two wide, shallow, spaced, longitudinal channels connected by a flat ridge, and edge portions along said side edges, and said outer skin panels have a center section with two wide, shallow, spaced, longitudinal channels connected by a flat ridge, and edge portions along said side edges.

7. The system as set forth in claim 6 wherein said inner skin panels and said outer skin panels include a plurality of large corrugations extending across said central section, said large corrugations being spaced inwardly from said edge portions, whereby said large corrugations provide rigidity between said side edges.

8. The system as set forth in claim 7 wherein said inner skin panels and said outer skin panels include a plurality of small corrugations extending from said large corrugations across said edge portions, whereby said small corrugations balance stress and shrinkage from forming said large corrugations.

9. The system as set forth in claim 5 wherein said inner and outer batten panels have a channel shape with a center portion, two spaced side portions that extend transversely from said center portion and two edge portions along said side edges.

10. The system as set forth in claim 9 wherein said inner and outer batten panels include a plurality of large corrugations extending across said central portion, whereby said large corrugations provide rigidity between said side edges.

11. The system as set forth in claim 10 wherein said inner and outer batten panels include a plurality of small corrugations extending across said side portions and said edge portions.

12. The system as set forth in claim 1 wherein said wall portions each have a lower end, said inner cladding panels each extend from said roof peak to said lower end and said outer cladding panels each extend from said roof peak to said lower end.

13. The system as set forth in claim 1 wherein said frame elements and said metal layer of said inner and outer cladding panels are made from light gauge metal.

14. The system as set forth in claim 1 wherein said frame elements and said metal layer of said inner and outer cladding panels are roll formed.

15. The system as set forth in claim 1 wherein said insulation layer of said inner and outer cladding panels is aluminized foil-bubble insulation.

16. A metal building system comprising:

a foundation having a substantially flat floor and two laterally spaced, longitudinally extending sets of spaced base rails that project upwardly relative to said floor, a plurality of longitudinally spaced building sections each having two longitudinally spaced frame elements, inner skin panels and outer skin panels, said frame elements each including two laterally spaced wall portions each having a lower end and an upper end, and two roof portions that each connect to said upper end of one of said wall portions and extend upwardly and inwardly, said roof portions connecting to each other at a roof peak opposite said wall portions, each of said wall and roof portions having an inner frame chord with an inner edge having a shaped inner flange, a spaced outer frame chord with an outer edge having a shaped outer flange and a plurality of struts connecting said inner and outer chords, said wall portions and said inner and outer chords of said wall portions being spaced to receive said base rails at said lower ends, said inner skin panels extending between said wall portions and between said roof portions of said frame elements, said inner skin panels having two spaced side edges, said inner skin panels including a metal layer and an insulation layer attached to and coextensive with said metal layer, said insulation layer facing towards said wall and roof portions, said side edges each having a seam that connects said inner skin panel to said inner flanges of said wall and roof portions of said frame elements with said insulation layer separating and spacing said metal layer from said inner flanges, said outer skin panels extending between said wall portions and between said roof portions of said frame elements, said outer skin panels having two spaced side edges, said outer skin panels including a metal layer and an insulation layer attached to and coextensive with said metal layer, said insulation layer facing towards said wall and roof portions, said side edges each having a seam that connects said outer skin panel to said outer flanges of said wall and roof portions of said frame elements with said insulation layer separating and spacing said metal layer from said outer flanges, inner batten panels extending between said wall portions and between said roof portions of said frame elements of adjacent building sections, said inner batten panels having two spaced side edges, said inner batten panels including a metal layer and an insulation layer attached to and coextensive with said metal layer, said insulation layer facing towards said wall and roof portions, said side edges each having a seam that connects said inner batten panel to said inner flanges of said wall and roof portions of said frame elements with said insulation layer separating and spacing said metal layer from said inner flanges, and outer batten panels extending between said wall portions and between said roof portions of said frame elements of adjacent building sections, said outer batten panels having two spaced side edges, said outer batten panels including a metal layer and an insulation layer attached to and coextensive with said metal layer, said insulation layer facing towards said wall and roof portions, said side edges each having a seam that connects said outer cladding panel to said outer flanges of said wall and roof portions of said frame elements with said insulation layer separating and spacing said metal layer from said outer flanges, whereby said insulation layers on said inner and outer skin and batten panels thermally isolate said inner and outer skin and batten panels from said frame elements, and said inner and outer skin and batten panels create dead-air space for improved resistance to heat transfer.

* * * * *